US005979465A

United States Patent [19]

Marrese et al.

[11] Patent Number: 5,979,465

[45] Date of Patent: Nov. 9, 1999

[54] THREADED HAIR TWISTER

[75] Inventors: Maureen Marrese; Lisa Marrese, both of New York, N.Y.

[73] Assignee: Marrese, Inc., New York, N.Y.

[21] Appl. No.: 09/008,434

[22] Filed: Jan. 16, 1998

[51] Int. Cl.[6] ..... A45D 2/14; A45D 2/18; A45D 2/00; A45D 2/08

[52] U.S. Cl. ..... 132/248; 132/245; 132/246; 132/247; 132/250; 132/251

[58] Field of Search ..... 132/245, 248, 132/247, 246, 222, 253, 273, 254, 250, 251

[56] References Cited

U.S. PATENT DOCUMENTS

| | | | |
|---|---|---|---|
| 2,145,278 | 1/1939 | Solomon | 132/44 |
| 2,325,547 | 7/1943 | Reiter | 132/42 |
| 4,844,103 | 7/1989 | Vick et al. | 132/245 |
| 5,303,723 | 4/1994 | Schach | 132/246 |
| 5,553,631 | 9/1996 | Schach | 132/210 |

*Primary Examiner*—John J. Wilson
*Assistant Examiner*—Robyn Doan
*Attorney, Agent, or Firm*—Fitzpatrick, Cella, Harper & Scinto

[57] ABSTRACT

A threaded hair twister that is flexible, easy to use, and light-weight and enables the user to coil the hair into a variety of twists comprised of an elongated resilient body having an opening at one end and an elastic cord attached to a needle-like member at the other end, wherein the needle-like member is threaded into the opening of the elongated body for securing the hair after being rolled into a twist style.

18 Claims, 3 Drawing Sheets

FIG.1
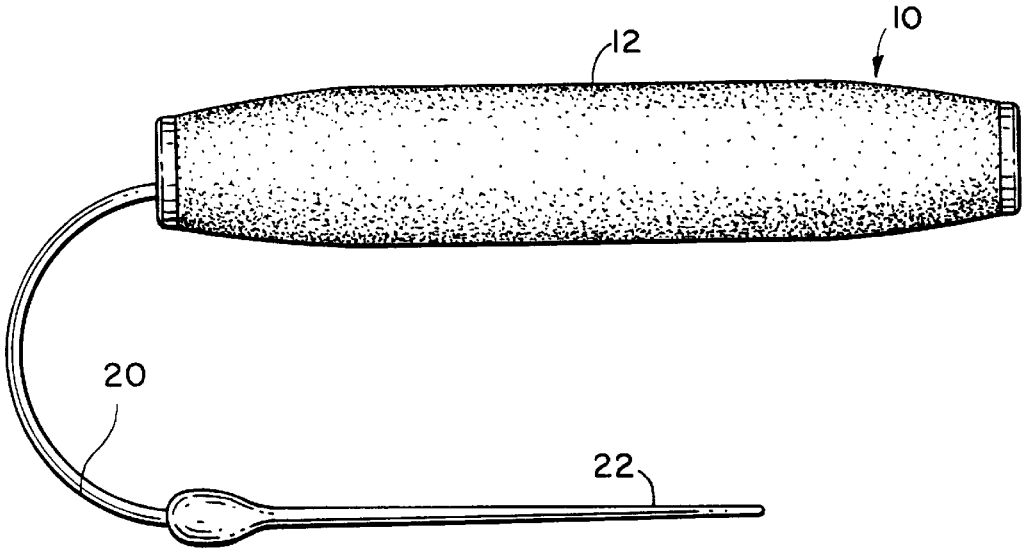
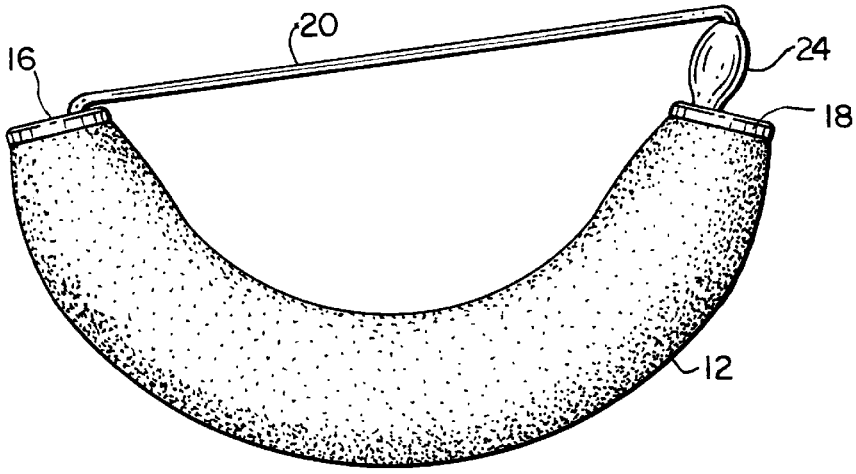
FIG.2

THREADED HAIR TWISTER

FIELD OF THE INVENTION

The present invention relates to a hair styling device and more particularly to a hair styling device that is resilient and can coil hair into many diverse styles, for example, a French twist, half twist, or side twist, without needing additional pins or clips.

The device of the present invention preferably includes an elongated member comprising a resilient flexible core covered by an outer sheath of textured material or foam that clings to hair and a retention member to secure the hair into a number of desired twists.

BACKGROUND OF THE INVENTION

It is known in the prior art to utilize hair shaping devices to style hair into a variety of styles depending on the length of the hair and the desired effect, but none of the teachings incorporate the unique aspects of the present invention. Rather, the prior art shaping and hair retention devices are either bulky, utilize separate clamping means and are not comprised of a unitary simple hair twister and fastener, as in the present invention, to permit the user to create a variety of hair twists simply and efficiently without damaging the hair and causing any discomfort.

The following prior art patents are illustrative of prior devices for wrapping, curling and styling hair.

U.S. Pat. No. 19,228 to Arnold describes a clamp for holding ladies' hair in curls consisting of a rigid tube having elastic straps for setting hair after it is curled about the tube. U.S. Pat. No. 951,066 to Fisher again relates to a rigid hair curler utilizing hair pins and rubber bands for waving the hair. U.S. Pat. No. 2,145,278 to Solomon is directed towards a hair curler comprised of a one piece resilient body and an integrally and swingably connected retaining member. U.S. Pat. No. 2,242,850 to Dusseau relates to a hair curler consisting of a rigid tubular body connected to an elastic cord and having a metal clip pin attached to the other end. The metal clip pin is comprised of two spring arms to be used to straddle the tubular body to clamp a wisp of hair into place. U.S. Pat. No. 2,693,809 to Spencer relates to a to a curler and method of treating hair and discloses a rigid hair curler having an oil or lubricant impregnated body and relatively lubricant free retaining tabs so that when the curler is wrapped with hair, no lubricant escapes onto a pillow when worn during sleep. These prior art patents relate to devices to curl hair and set it, not to devices for creating different hair styles.

U.S. Pat. No. 5,303,723 to Schach is directed towards a hair styling device comprising a peanut shaped outer covering of material capable of clinging to hair, at least one intermediate layer of a resilient film attached along its periphery to the outer covering to form a unitary structure, and a deformable structure in the interior capable of being repeatedly bent to form a variety of shapes. The patent does not disclose a cooperating retention member to hold the hair in the desired twisted shape. Since it relies solely on the hair clinging to the fabric cover it is likely that the hair will not stay in place but unwind, requiring that the hair be retwisted and set again.

The prior art noted above fails to provide or suggest a flexible elongated hair twister having a cooperating retention member to allow an individual to create and to maintain a variety of hair twist styles by manipulating a flexible core into a variety of shapes to create a number of different hair styles with the same device. More particularly, the prior art has failed to provide a light-weight, flexible, low cost hair styling device that allows the individual the options of styling the hair in a French twist, half twist or side twist with the assurance that the hair will stay in place.

OBJECTS AND SUMMARY OF THE INVENTION

In accordance with an aspect of this invention, there is provided an elongated hair styling device for coiling hair into a variety of twists. In one preferred embodiment a somewhat stiff but flexible core which can be bent and retains its bent shape is provided. The core may be formed of a plurality of flexible parallel tubes to form an elongated body and disposed about a wire member, such as copper, of sufficient thickness to allow bending while retaining the shape to which it is bent. Alternatively, a flexible core of a bendable plastic material may be used as well or a piece of insulated electrical wire cable of sufficient thickness to allow flexibility while retaining its shape. The core is covered by a sponge like foam fabric sheath which clings to hair. End caps are provided at each end of the device. An elastic cord is fixed to one end cap and is provided with a stiff yet flexible elongated member at its end. The other end cap is provided with a receiving bore to receive the flexible elongated member. In a preferred device, the flexible elongated member is needle shaped and threads into the opposing end cap.

An object of the present invention is to provide a hair twister device that conveniently and rapidly styles hair in a variety of twists which addresses the problems associated which the prior art has failed to adequately provide.

More specifically, it is an object of the present invention to provide a flexible hair twister having a thin elongated body that is adaptable to different hair lengths and hair thicknesses.

Another object of the present invention is to provide a hair twister that provides an elastomeric means to secure the hair style without damaging the hair.

It is still another object of the present invention to provide a relatively low-cost hair twister, which is simple in construction, easy to use, durable, small in size, less cumbersome and neat and attractive in appearance when placed in the hair than prior art hair styling devices.

A yet further object of the present invention is to provide a hair styling device without the need of pins, clips, or other external fastening means.

It is yet another object of the present invention to provide a hair twister readily adaptable to a wide variety of hair lengths and hair thicknesses.

Other objects, features and advantages according to the present invention will become apparent from the following detailed description of the illustrated embodiments when read in conjunction with the accompanying drawings in which corresponding components are identified by the same reference numerals.

BRIEF DESCRIPTION OF THE DRAWINGS

FIG. 1 is a side view of an unthreaded hair twister of the present invention;

FIG. 2 is a side view of a threaded hair twister of the present invention in a curved position;

DETAILED DESCRIPTION

Figure 3:
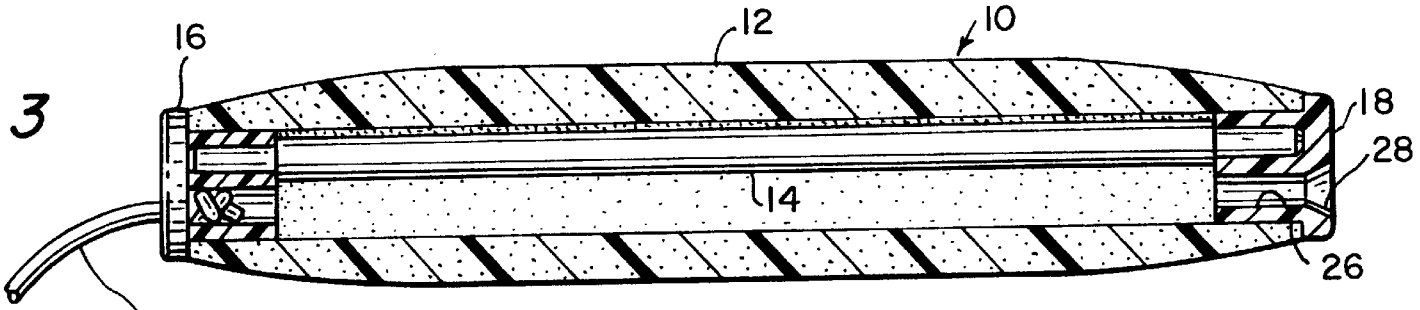
FIG. 3 is a longitudinal sectional view of the hair twister of the present invention.

FIGS. 1 and 2 illustrate the elongated hair twister 10 unthreaded and threaded having a slightly curved shape in accordance with a preferred embodiment of the present invention. As shown therein and with reference to all of the FIGS. 1–7, the hair twister 10 includes an outer layer or sheath 12, at least one inner flexible core member 14, although two or more core members may be employed, to form the durable yet resilient hair twister. End caps 16 and 18, respectively, are provided at each end. An elastic expandable cord 20 is fixed to one end cap, for example by a knot 22 in one end. A flexible but rigid needle or pick is secured at the free end to the cord 20 and is provided with a ball member 24 at the juncture with cord 20. Core member 14 is suitably secured in any convenient manner in each end cap 16 and 18.

The outer sleeve 12 is preferably formed from a foam, felted or any other textured type material that has the ability to cling to hair, preferably such as polyether or polyester, polyurethane or polyurethane esther foam. In addition, the foam type material comprising the outer sheath may be vulcanized rubber, foamed polyethylene, foamed polyvinyl or like materials known to be foamable under like conditions. It is preferred that the outer sheath which contacts the hair be comprised of a material or fabric that does not snag or tangle the hair when wrapped or coiled into a twist and formed to have a slight bulge in the center and provides a compressable sponge like feel.

The elastic cord 20 is formed form a springy durable material or preferably a rubber material, while the pick or needle member 22 is made of a flexible rubber type material being sturdier and having less elasticity than the elastic cord 20.

End cap 18 differs from end cap 16 in that it has a receiving bore 26 and a cone shaped seat 28 to receive needle 22 and bulb 24 and retain, it snugly within end cap 18, as shown in FIG. 2. When the needle is fully inserted in receiving bore 26, the tension imparted by elastic cord 20 cooperates with the mating engagement of ball member 24 and seat 28 to retain the needle in a fixed position. Accordingly, when needle member 22 is engaged cord 20 contacts a portion of the coiled hair and assures that the hair twist will remain in position and not loosen or come apart while worn.

Figure 4:
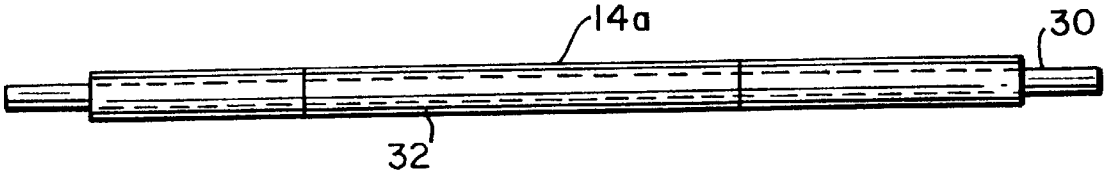
FIG. 4 is a side view of one embodiment of the core member of the present invention.
Figure 5:
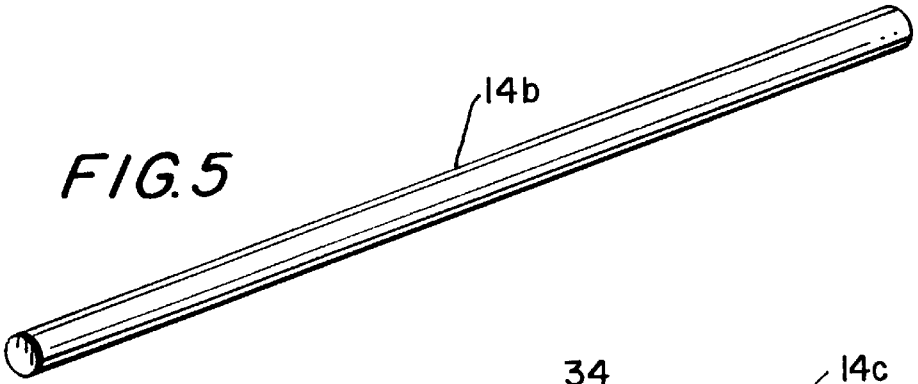
FIG. 5 is a perspective view of an alternate embodiment of the core member of the present invention.
Figure 6:
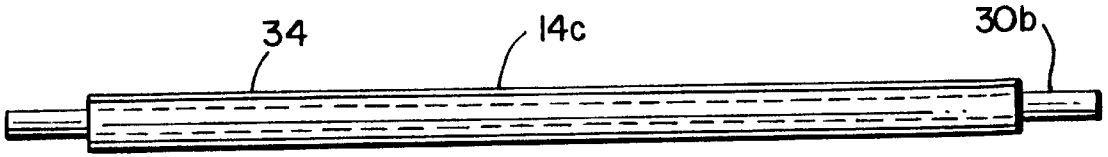
FIG. 6 is a side view of another embodiment of the core member of the present invention.

As best seen in FIG. 3, the sheath 12 is disposed about core member 14 which is any suitable member or material selected to be flexible so as to be readily bent and, when bent, sufficiently rigid to substantially retain the shape to which it is bent. FIGS. 4, 5 and 6, illustrate by way of example only, types of structures for flexible core 14.

In FIG. 4 the core 14 is constructed of a wire 30 of a gauge to be flexible yet which exhibits the ability to retain the shape to which it is bent. About wire 30 are disposed a plurality of short cylindrical segments 32 which may be held together by an adhesive type wrapped around each joint (not shown). The cylindrical segments permit bending of the core as the segments can articulate at each juncture. The cylindrical segments increase the interior volume of the core so that the device as a whole exhibits sufficient rigidity to permit coiling of the user's hair to the desired style.

FIG. 5 illustrates an alternate core member 14*b* which can be any type of flexible metal or plastic which can be repeatedly bent without fracturing. The core 14*b* can also be two or more metal bars encased in a plastic sheath, if desired.

FIG. 6 illustrates another alternate core member which can be similar to an electrically conductive wire having a metal wire 30*b* of sufficient gauge to be flexible and shape retentive encased by a plastic or elastomeric sheath 34.

Figure 7A:
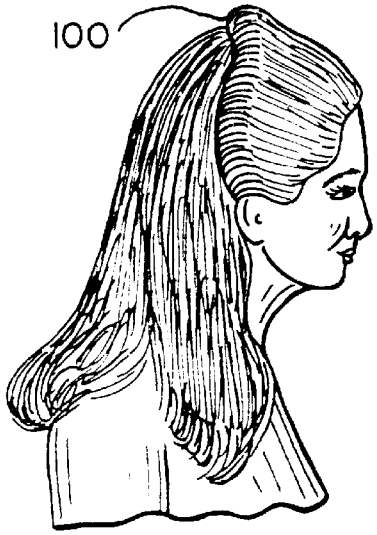
FIGS. 7A, 7B, and 7C are perspective views showing how the hair twister device of the present invention forms a half twist, a French twist, and a side twist, respectively.
Figure 7B:
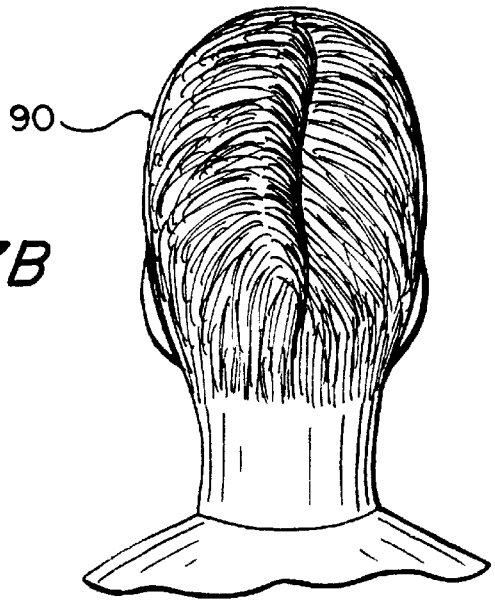
Figure 7C:
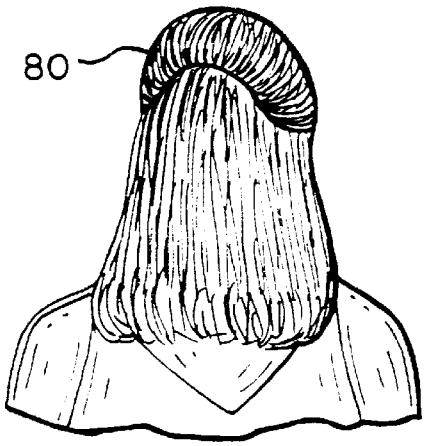

FIGS. 7A–7C show three 80, 90 and 100 of the many different types of hair twists that an individual can do by herself when using the hair twister of the present invention. The twist styles are formed by rolling the hair about the elongated sheath 12 either parallel to the head for styles shown in FIGS. 7A–7B or perpendicular to the head for the style in FIG. 7C. Then, once the desired hair is totally coiled or rolled around the sheath 14 the needle 22 is threaded into the opening and seated in socket 28 to clamp and secure the hair in place. Further, the individual can adjust the angle of the hair twister due to the resilient material comprising the device. As seen in FIG. 7A the device follows a semi-circular contour about the top of the head. To undo the hair twister device, the individual simply removes the needle 22 and unrolls the hair from the elongated body.

It is readily apparent that the twister device of the present invention may be made in various lengths and thicknesses to achieve a wide variety of hair styles and two or more devices may be used at the same time to achieve even more diversity of hair styles.

Accordingly, the hair twister of the present invention forms an aesthetically pleasing hair styles or updos without any obstructions or intrusions from additional external objects, such as hair clamps, pins, clips, scrunchies, or the like.

Furthermore, although preferred embodiments of the present invention and modifications thereof have been described in detail herein, it is to be understood that this invention is not limited to those precise embodiments and modifications, and that other modifications and variations may be affected by one skilled in the art without departing from the spirit and scope of the invention as defined by the appended claims.

What is claimed is:

1. A hair styling device for coiling and retaining hair into a variety of different styles comprising:

an elongate member having an outer surface of a material capable of clinging to hair when hair is coiled thereabout;

a core member disposed within said elongate member;

said core member being deformable and capable of retaining the shape to which it is deformed;

an elastomeric cord member disposed at one end of said elongate member;

said elastomeric cord member including a needle member of a flexible but rigid material at its end;

said core member at its other end including a needle receiving bore therein to receive and retain said needle member after hair is coiled about said core member;

whereby said elastomeric cord member secures and retains hair coiled about said elongate member when said needle member is disposed within said bore.

2. The hair styling device of claim 1, wherein said core member comprises a plurality of discrete tubular segments disposed about a cylindrical wire having a sufficient gauge to provide flexibility while being shape retentive after being bent.

3. The hair styling device of claim 1, wherein said core member comprises a wire member having a sufficient gauge to provide flexibility while being shape retentive after being bent wherein said wire member is encased in a plastic sheath.

4. The hair styling device of claim 1, wherein said core member comprises a flexible plastic material which can be repeatedly bent without fracturing and which is shape retentive after being bent.

5. The hair styling device according to claim 1, wherein said core member comprises a wire having a sufficient gauge to provide flexibility while being shape retentive after being bent wherein said wire is encased by a flexible plastic or rubber covering.

6. The hair styling device of claim 1, wherein said outer surface material is a foam sheath.

7. The hair styling device of claim 6, wherein said foam sheath may be a polyether, polyester, polyurethane, polyurethane ester foam, foamed polyethylene, foamed polyvinyl or rubber.

8. The hair styling device of claim 1, wherein said needle member includes a bulbous portion adjacent the juncture of said needle member with said cord and said other end of said elongate member includes a widened receiving bore to receive and retain said bulbous portion when said needle member is inserted into said needle receiving bore.

9. A hair styling device for coiling and retaining hair into a variety of different styles comprising:

an elongate member including a core member and an outer sheath of material capable of clinging to hair when hair is coiled thereabout;

said elongate member being deformable and capable of retaining the shape to which it is deformed;

end caps at each end of said elongate member;

an elastomeric cord secured to one end cap;

a somewhat rigid yet flexible needle member disposed at one end of said cord; and a needle receiving bore disposed within the other end cap to receive and retain said needle when said needle is inserted therein thereby to secure and retain hair coiled about said elongate member.

10. The hair styling device of claim 9, wherein said core member comprises a plurality of discrete tubular segments disposed about a cylindrical wire having a sufficient gauge to provide flexibility while being shape retentive after being bent.

11. The hair styling device of claim 9, wherein said core member comprises a wire member having a sufficient gauge to provide flexibility while being shape retentive after being bent wherein said wire member is encased in a plastic sheath.

12. The hair styling device of claim 9, wherein said core member comprises a flexible plastic material which can be repeatedly bent without fracturing and which is shape retentive after being bent.

13. The hair styling device according to claim 9, wherein said core member comprises a wire having a sufficient gauge to provide flexibility while being shape retentive after being bent wherein said wire is encased by a flexible plastic or rubber covering.

14. The hair styling device of claim 9, wherein said needle includes a bulbous portion adjacent the juncture of said needle with said cord and said housing includes a seat to receive and retain said bulbous portion.

15. The hair styling device of claim 9, wherein said outer sheath is a foam material of polyether, polyester, polyurethane, polyurethane ester foam, formed polyurethane, foamed polyvinyl or rubber.

16. The hair styling device according to claim 1 wherein said core member is substantially cylindrical.

17. The hair styling device of claim 9 wherein said core member is substantially cylindrical.

18. The hair styling device of claim 9, wherein said needle includes a bulbous portion adjacent the juncture of said needle with said cord and said needle receiving bore includes a seat to receive and retain said bulbous portion.

* * * * *